US011867186B2

(12) United States Patent
Nygaard et al.

(10) Patent No.: US 11,867,186 B2
(45) Date of Patent: Jan. 9, 2024

(54) SENSOR ARRANGEMENT AND METHOD FOR MONITORING A CIRCULATION PUMP SYSTEM

(71) Applicant: GRUNDFOS HOLDING A/S, Bjerringbro (DK)

(72) Inventors: Michael Helbo Nygaard, Bjerringbro (DK); Flemming Munk, Bjerringbro (DK); Søren Kjeldsen, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 297 days.

(21) Appl. No.: 17/291,144

(22) PCT Filed: Oct. 14, 2019

(86) PCT No.: PCT/EP2019/077689
§ 371 (c)(1),
(2) Date: May 4, 2021

(87) PCT Pub. No.: WO2020/094334
PCT Pub. Date: May 14, 2020

(65) Prior Publication Data

US 2021/0388837 A1 Dec. 16, 2021

(30) Foreign Application Priority Data

Nov. 5, 2018 (EP) ..... 18204237

(51) Int. Cl.
*F04D 15/00* (2006.01)
*F04D 1/06* (2006.01)

(52) U.S. Cl.
CPC ..... *F04D 15/0088* (2013.01); *F04D 1/06* (2013.01)

(58) Field of Classification Search
CPC ..... F04D 15/0088; F04D 1/06
USPC ..... 73/168
See application file for complete search history.

(56) References Cited

U.S. PATENT DOCUMENTS 5,209,116 A * 5/1993 Okumura ..... G01M 1/22 73/462
2007/0071057 A1* 3/2007 Ohta ..... H01S 3/036 372/55

FOREIGN PATENT DOCUMENTS

EP 1972793 B1 7/2010
WO 2018122016 A1 7/2018

* cited by examiner

*Primary Examiner* — Nathaniel T Woodward
(74) *Attorney, Agent, or Firm* — McGlew and Tuttle, P.C.

(57) ABSTRACT

A sensor arrangement is for monitoring a circulation pump system (1) which includes at least one pump (3). The sensor arrangement includes a first vibration sensor (5) installed at a first pump part (11) of one of the at least one pump (3) and a second vibration sensor (7) installed at a second pump part (13) of the pump (3) and an evaluation module (9). The first pump part (11) and the second pump part (29) have a distance to each other. The evaluation module (9), is configured to discriminate between at least two of k≥2 different types of faults based on comparing first signals received from the first vibration sensor (5) and second signals received from the second vibration sensor (7).

27 Claims, 3 Drawing Sheets

SENSOR ARRANGEMENT AND METHOD FOR MONITORING A CIRCULATION PUMP SYSTEM

CROSS REFERENCE TO RELATED APPLICATIONS

This application is a United States National Phase Application of International Application PCT/EP2019/077689, filed Oct. 14, 2019, and claims the benefit of priority under 35 U.S.C. § 119 of European Application 18204237.4, filed Nov. 5, 2018, the entire contents of which are incorporated herein by reference.

TECHNICAL FIELD

The present disclosure is directed to a sensor arrangement and a method for monitoring a circulation pump system.

TECHNICAL BACKGROUND

It is known to use a vibration sensor in a pump assembly for detecting operating faults. For instance, EP 1 972 793 B1 describes a method and pump assembly using a vibration sensor for detecting operating faults, wherein the influence of the rotational speed of the rotating shaft is eliminated for analyzing the vibration signal.

However, in a circulation pump system with one or more pumps, a vibration signal that is interpreted as a pump fault may in fact originate from outside the pump by travelling into the pump via the piping connected to the pump. The fault may in fact be in another pump, a faulty valve or other sources in or connected to the piping.

It is thus desirable to reduce the risk of misinterpreting signals originating from outside of the pump as internal operating faults of the pump.

SUMMARY

Embodiments of the present disclosure provide a solution to this problem by providing a sensor arrangement and a method for monitoring a circulation pump system, and a circulation pump system with at least one pump comprising such a sensor arrangement.

In accordance with a first aspect of the present disclosure, a sensor arrangement for monitoring a circulation pump system with at least one pump, wherein the sensor arrangement comprises

- a first vibration sensor installed at a first pump part of one of the at least the pump,
- a second vibration sensor installed at a second pump part of said pump, wherein the first pump part and the second pump part have a distance to each other, and
- an evaluation module,
- wherein the evaluation module is configured to discriminate between at least two of k≥2 different types of faults based on comparing first signals received from the first vibration sensor and second signals received from the second vibration sensor.

For instance, in a simple example, the evaluation module may be configured to discriminate between two types of faults: internal pump fault and fault external to the pump. Comparing between the first signals and the second signals may, for instance, reveal that both sensors detect a very similar vibration, but the second vibration sensor, e.g. being located closer to the pump inlet than the first vibration sensor, detects that vibration earlier than the first vibration sensor, e.g. being installed further away from the pump inlet than the second vibration sensor. In this case, the evaluation module may indicate a fault external to the pump, most likely somewhere upstream in the inlet piping. Vice versa, an internal pump fault may be indicated when the first vibration sensor, e.g. being installed further away from the pump inlet than the second vibration sensor, detects a vibration earlier than the second vibration sensor, e.g. being installed closer to the pump inlet than the first vibration sensor. The first vibration sensor may be installed at a pumphead of the pump. The second vibration sensor may be installed near the pump inlet or pump outlet. In addition, a third vibration sensor may be installed near the other one of the pump outlet and pump inlet, respectively, in order to be able to discriminate between inlet-sided external faults and outlet-sided external faults.

It is important to note that the discrimination between types of faults may not only be based on a comparison of run-time information of the first signals and the second signals. The comparison of the first signals and the second signals as such may increase the confidence in the discrimination between pump faults. Therefore, the sensor arrangement disclosed herein is not only beneficial to reduce the risk of misinterpreting signals originating from outside of the pump as internal operating faults of the pump, but also to reduce the risk of misinterpreting signals as one type of internal fault, whereas in fact another type of internal fault caused the vibration. For instance, the second signals can be used to reject or validate a discrimination between types of faults that was based on the first signals.

The first signals and/or the second signals may be analogue or digital signals generated by the first vibration sensor and/or second vibration sensor upon detecting vibrations of the pump structure and/or of the fluid to be pumped. The first signals and/or the second signals may thus represent the vibrations detected by the first and/or second vibration sensor, respectively. The first signals and/or the second signals may be communicated optically via optical fiber, electrically by wire or wirelessly to the evaluation module. The evaluation module may be implemented in the electronics of the first vibration sensor and/or second vibration sensor or implemented separately from the vibration sensors. It may be implemented as hardware and/or software in the electronics of the pump or a control module external to the pump. Alternatively, or in addition, the evaluation module may be implemented in a remote computer device and/or a cloud-based control system.

The vibration sensors may include a vibration sensing element (e.g. in form of an acceleration sensor element, an optical sensor element, a microphone, a hydrophone, and/or a pressure sensor element). The vibration sensor may detect vibrations of the mechanical structure of the pump and/or vibrations of the pumped fluid in form of pressure waves. The vibrations may be structure-borne and/or fluid-borne sound waves that travel through the pump structure and/or the fluid to be pumped. In the pumped fluid, the vibration waves may be longitudinal, whereas they may be transverse and/or longitudinal in the mechanical structure of the pump. Most preferably, the vibration sensors may be configured to detect longitudinal structure-borne and/or fluid-borne vibration waves. For those longitudinal vibration waves, the propagation speed v may be determined by the Newton-Laplace equation:

$$v = \sqrt{\frac{K}{\rho}},$$

wherein K is the bulk modulus and p the density of the medium through which the vibration waves propagate.

Optionally, the different types of faults may comprise at least a subset N of $1 \leq n \leq k$ types of internal faults originating inside the pump, the subset N comprising at least one type of fault selected from the group consisting of: speed fault, pressure fault, misalignment, bearing fault, drive-end (DE) bearing fault, non-drive-end (NDE) bearing fault, impeller fault, cavitation, dry-running, and water hammer. Any of speed fault, misalignment, bearing fault, drive-end (DE) bearing fault, non-drive-end (NDE) bearing fault, impeller fault, cavitation, and water hammer may have a specific vibration characteristic that may be analysed to distinguish between the different types of faults. Dry-running may be detected by an ultrasonic sensor element integrated in the first and/or second vibration sensor. The first and/or second vibration sensor may thus be a multi-functional sensor having a variety of integrated sensing elements.

Optionally, the different types of faults may comprise at least a subset M of $1 \leq m \leq k$ types of external faults originating outside the pump, the subset M comprising at least one type of fault selected from the group consisting of: external fault, inlet-sided external fault and outlet-sided external fault.

Optionally, the different types of faults may comprise at least a subset N of $1 \leq n < k$ types of internal faults originating inside the pump and a subset M of $1 \leq m < k$ types of external faults originating outside the pump.

Optionally, the evaluation module may be configured to discriminate between at least two of $k \geq 2$ different types of faults based on the first signals and to validate or reject such a discrimination based on the second signals. These can be types of internal and/or external faults.

Optionally, the first vibration sensor may comprise a vibration sensor element and at least one sensor element selected from the group consisting of: pressure sensor element, accelerometer element, ultrasonic sensor element and optical sensor element.

Optionally, the second vibration sensor may comprise a vibration sensor element and at least one sensor element selected from the group consisting of: pressure sensor element, accelerometer element, ultrasonic sensor element, optical sensor element.

Optionally, the evaluation module may be configured to discriminate between types of faults based on a comparison of run-time information of the first signals and the second signals. For example, a different time-of-arrival of vibration waves at the first and second vibration sensor may indicate whether it is an internal or external fault, respectively.

Optionally, the first vibration sensor may be located at a pumphead of the pump and the second vibration sensor is located at an inlet or outlet of the pump. Optionally, a third vibration sensor may be located at the other one of the inlet and outlet. This may facilitate the discrimination between inlet-sided external faults and outlet-sided external faults.

Optionally, the evaluation module may be configured to compare a first frequency spectrum of the first signals with a second frequency spectrum of the second signals. Before the frequency spectrums are compared by the evaluation module, a filtering, e.g. a Savitzky-Golay filter or locally weighted scatterplot smoothing (LOWESS), may be applied to the first and second signals that are preferably digitally generated by the first and second vibration sensors. The filtering is preferably linear, i.e. the phase response of the filter is preferably a linear function of frequency. A Fast Fourier Transformation (FFT) may be applied to the filtered first and second signals to generate the first and second frequency spectrum, respectively.

Optionally, the evaluation module may be configured to determine a degree of coherence between the first signals and the second signals. Preferably, first and second frequency spectrums of the first and second signals may be used as input into a magnitude squared coherence (MSC) estimate, wherein a Welch's averaged, modified periodogram method may be applied to get a spectral density estimation with reduced noise.

Optionally, the evaluation module may be integrated in the first vibration sensor and/or second vibration sensor.

Optionally, the evaluation module may be external to the first vibration sensor and second vibration sensor.

Optionally, the sensor arrangement may further comprise a communication module for wireless communication with a computer device and/or the evaluation module being external to the first vibration sensor and second vibration sensor. Optionally, the communication module may be integrated in the first vibration sensor and/or second vibration sensor.

In accordance with a second aspect of the present disclosure, a circulation pump system is provided comprising at least one pump and a sensor arrangement as described above.

Optionally, the at least one pump may be a multi-stage centrifugal pump with a stack of impeller stages, wherein a first vibration sensor of the sensor arrangement is installed at a first pump part, e.g. a pumphead of the pump, at a high-pressure side of the stack of impeller stages and a second vibration sensor of the sensor arrangement is installed at a second pump part, e.g. a base member comprising a pump inlet and/or a pump outlet, distanced to the first pump part. The first pump part may be a pumphead.

Optionally, the second vibration sensor of the sensor arrangement may be installed at the pump inlet and a third vibration sensor of the sensor arrangement may be installed at the pump outlet.

In accordance with a third aspect of the present disclosure, a method is provided for monitoring an operation of a circulation pump system comprising:

receiving first signals from a first vibration sensor arranged at a first pump part of a pump of the circulation pump system, receiving second signals from a second vibration sensor arranged at a second pump part of said pump of the circulation pump system, wherein the first pump part and the second pump part have a distance to each other, and discriminating between at least two of $k \geq 2$ different types of faults based on comparing the first signals and the second signals.

Optionally, the different types of faults may comprise at least a subset N of $1 \leq n \leq k$ types of faults originating inside the pump, the subset N comprising at least one type of fault selected from the group consisting of: speed fault, pressure fault, misalignment, bearing fault, drive-end (DE) bearing fault, non-drive-end (NDE) bearing fault, impeller fault, cavitation, dry-running, and water hammer.

Optionally, the different types of faults may comprise at least a subset M of $1 \leq m \leq k$ types of faults originating outside the pump, the subset M comprising at least one type of fault selected from the group consisting of: outside fault, inlet-sided outside fault and outlet-sided outside fault.

Optionally, the different types of faults may comprise at least a subset N of $1 \leq n < k$ types of faults originating inside the pump and a subset M of $1 \leq m < k$ types of faults originating outside the pump.

Optionally, the step of discriminating may comprise discriminating between at least two of $k \geq 2$ different types of faults based on the first signals and validating or rejecting such a discrimination based on the second signals.

Optionally, the step of discriminating may be based on a comparison of run-time information of the first signals and the second signals.

Optionally, the first vibration sensor may be located at a pumphead of the pump and the second vibration sensor is located at an inlet or outlet of the pump.

Optionally, the step of discriminating may comprise comparing a first frequency spectrum of the first signals with a second frequency spectrum of the second signals.

Optionally, the step of discriminating may comprise determining a degree of coherence between the first signals and the second signals.

Optionally, the method may further comprise a step of wirelessly communicating with a computer device and/or an evaluation module being external to the first vibration sensor and second vibration sensor.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION

Figure 1:
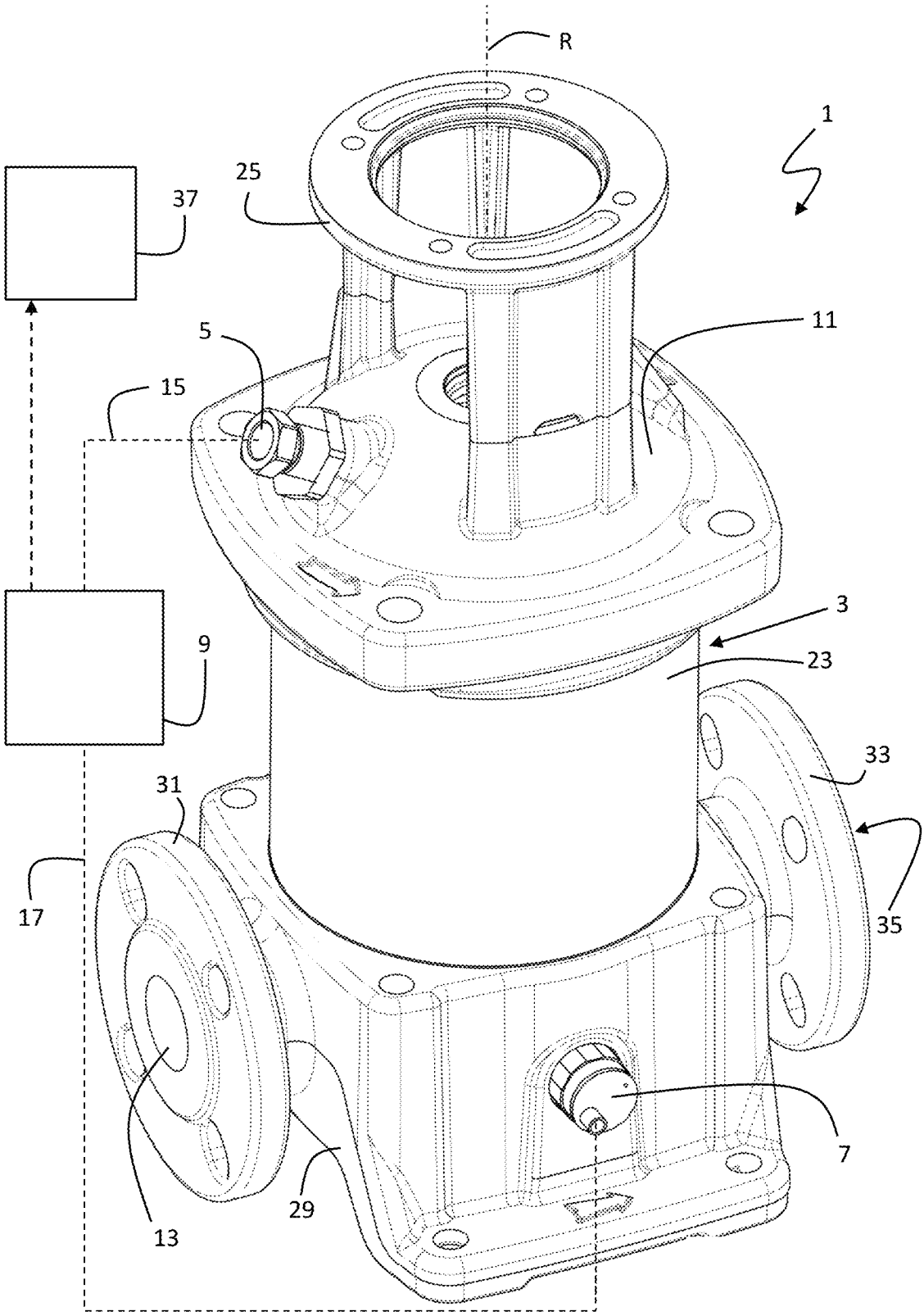
FIG. 1 is a perspective view on an example of a multi-stage circulation pump being equipped with a first embodiment of a sensor arrangement according to the present disclosure.

Referring to the drawings, FIG. 1 shows a circulation pump system 1 with a multi-stage centrifugal pump 3 being equipped with a first embodiment of a sensor arrangement comprising a first vibration sensor 5, a second vibration sensor 7 and an evaluation module 9. The first vibration sensor 5 is installed at first pump part, i.e. a pumphead 11. The second vibration sensor 7 is installed at a second pump part, i.e. a base member 29 comprising a pump inlet 13, distanced to the pumphead 11. The evaluation module 9 is implemented as hardware or software on a computer device external to the pump 3. A first communication line 15 between the first vibration sensor 5 and the evaluation module 9 may be optical, by wire or wireless, by way of which the evaluation module 9 is configured to receive first signals from the first vibration sensor 5. Analogously, a second communication line 17 between the second vibration sensor 7 and the evaluation module 9 may be optical, by wire or wireless, by way of which the evaluation module 9 is configured to receive second signals from the second vibration sensor 5.

The multi-stage centrifugal pump 3 as shown in FIG. 1 has a vertical rotor axis R along which a rotor shaft extends for driving a stack of several impeller stages within a pump housing 23. A motor stool 25 is mounted on the pumphead 11 to structurally support a motor (not shown) for driving the rotor shaft. The rotor shaft extends through a shaft seal 27 in the pumphead 11 towards the motor (not shown) supported by the motor stool 25. The pump housing 23 is essentially cylindrical and encloses the stack of impeller stages. The pumphead 11 forms an upper end of the pump housing 23, and the base member 29 forms a lower end of the pump housing 23. The base member 29 forms an inlet flange 31 and an outlet flange 33 for mounting piping (not shown). The base member 29 further forms a first fluid channel as the pump inlet 13 and a second fluid channel as a pump outlet 35. The distance between the pumphead 11 with the first sensor 5 and the pump inlet 13 with the second sensor 7 is mainly dependent on the number of impeller stages. The more impeller stages the pump 3 has, the longer the pump housing 23 between the base member 29 and the pumphead 11 is. It should be noted that the multi-stage centrifugal pump 3 may alternatively have a horizontal configuration, in which the rotor axis R extends horizontally.

The evaluation module 9 receives first signals via the first communication line 15 from the first vibration sensor 5 and second signals via the second communication line 17 from the second vibration sensor 7. The evaluation module 9 is configured to discriminate between at least two of $k \geq 2$, where ($k \in \mathbb{N}$), different types of faults based on comparing the first signals and the second signals. In a simple embodiment, these two types of faults may be "internal pump fault" and "fault external to the pump". Comparing between the first signals and the second signals may, for instance, reveal that both vibration sensors 5, 7 detect a very similar vibration, but the second vibration sensor 7 detects that vibration earlier than the first vibration sensor 5. In this case, the evaluation module 9 indicates a fault external to the pump, most likely somewhere upstream in the inlet piping. Vice versa, an internal pump fault may be indicated when the first vibration sensor 5 detects a vibration earlier than the second vibration sensor 7. Based on the discrimination between external and internal faults, the evaluation module 9 may trigger an information broadcast and/or an alarm, e.g. visual, haptic and/or audible, on a stationary or mobile computer device 37 of an operator.

The first vibration sensor 5 and the second vibration sensor 7 are preferably multi-functional sensors including not only a vibration sensing element (e.g. in form of an acceleration sensor element, an optical sensor element, a microphone, a hydrophone, and/or a pressure sensor element) but also other integrated sensing elements. Thereby, receiving the first signals enables the evaluation module 9 to differentiate between a subset N of $1 \leq n \leq k$ types of internal faults originating inside the pump 3, e.g. speed fault, pressure fault, misalignment, bearing fault, drive-end (DE) bearing fault, non-drive-end (NDE) bearing fault, impeller fault, cavitation, dry-running, and water hammer. A high temperature indicating a temperature fault may be detected by an additional temperature sensing element integrated in the first vibration sensor 5. Any of speed fault, misalignment, bearing fault, drive-end (DE) bearing fault, non-drive-end (NDE) bearing fault, impeller fault, cavitation, and water hammer may have a specific vibration characteristic that may be analyzed by the evaluation module 9 to distinguish between the different types of internal faults. Dry-running may be detected by an ultrasonic sensor element integrated in the first vibration sensor 5.

The second signals from the second vibration sensor 7 are used by the evaluation module to validate or reject a discrimination among types of internal faults that the evaluation module 9 has based on the first signals alone. Based on the validated discrimination among internal fault types, the evaluation module 9 may trigger an information broadcast and/or an alarm, e.g. visual, haptic and/or audible, on a stationary or mobile computer device 37 of an operator. Thus, the confidence in the discrimination can be increased and incorrect alarms prevented by comparing the first signals and the second signals.

Figure 2:
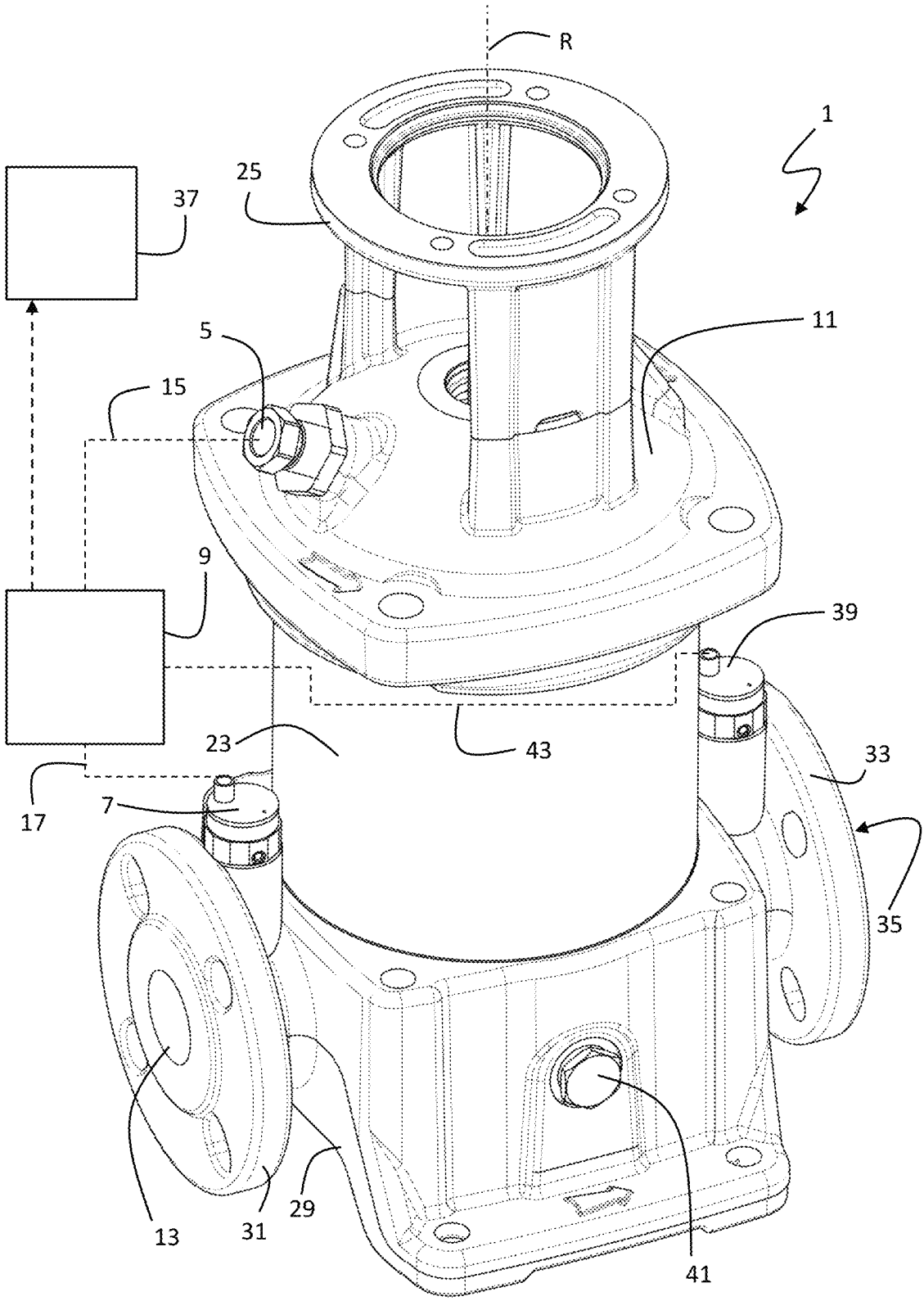
FIG. 2 is a perspective view on an example of a multi-stage circulation pump being equipped with a second embodiment of a sensor arrangement according to the present disclosure.

FIG. 2 shows a circulation pump system 1 with a multistage centrifugal pump 3 being equipped with a second embodiment of a sensor arrangement comprising the first vibration sensor 5, the second vibration sensor 7, a third vibration sensor 39 and the evaluation module 9. The central opening in the base member 29, in which the second sensor 7 was located in the first embodiment shown in FIG. 1, is now closed by a plug 41 in the second embodiment shown in FIG. 2. The second sensor 7 is now located at the side of the base member 29, where the pump inlet 13 is located. The third sensor 39 is analogously located at the other side of the base member 29, where the pump outlet 35 is located. The evaluation module 9 receives first signals via the first communication line 15 from the first vibration sensor 5, second signals via the second communication line 17 from the second vibration sensor 7, and third signals via a third communication line 43 from the third vibration sensor 39. The time delay between the third signals and the second signals may be analyzed by the evaluation module 9 to distinguish between inlet-sided external faults and outlet-sided external faults.

Figure 3:
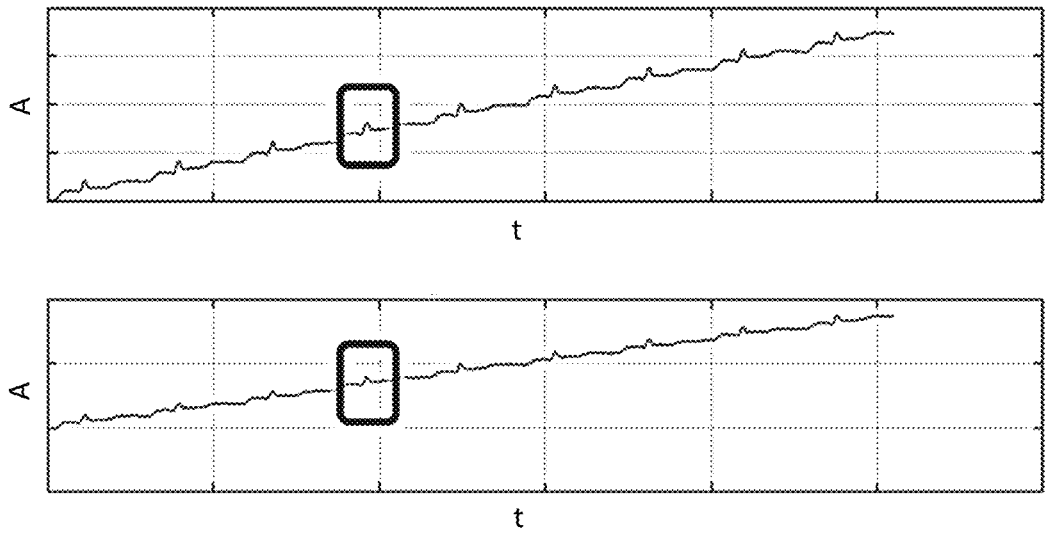
FIG. 3 is a view showing diagrams of the cumulative sum of filtered vibration amplitudes A versus time t detected by the first vibration sensor and the second vibration sensor of a sensor arrangement according to the present disclosure.
Figure 4:
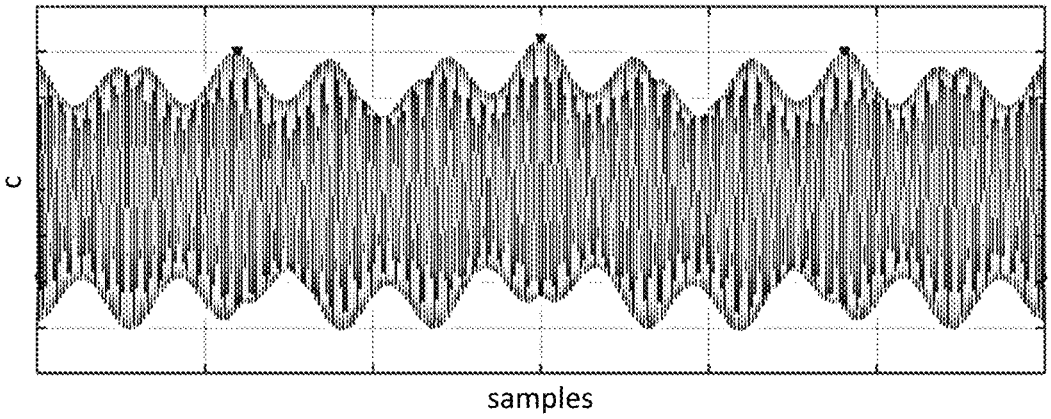
FIG. 4 is a diagram of a coherence c between the first signals sensor and the second signals over the number of samples processed by an evaluation module of the sensor arrangement according to the present disclosure.
Figure 5:
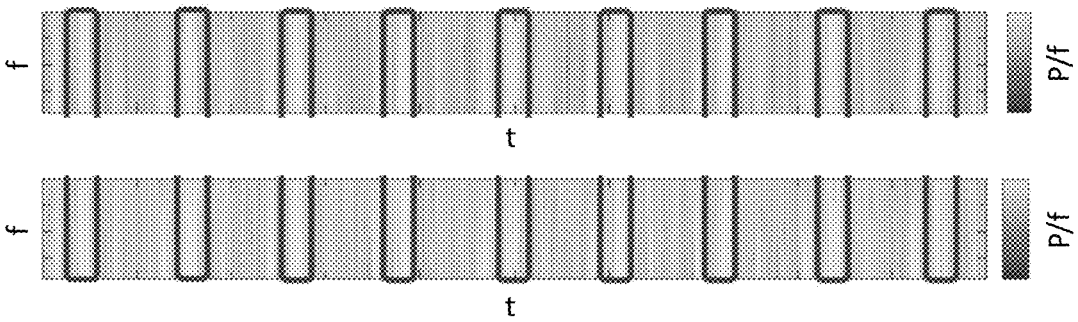
FIG. 5 is a spectrogram of vibration frequencies f versus time t and a spectral density of power per frequency P/f detected by the first vibration sensor and the second vibration sensor of a sensor arrangement according to the present disclosure.

FIG. 3 shows the cumulative sum of filtered vibration amplitudes A versus time t detected by the first vibration sensor 5 (upper diagram) and the second vibration sensor 7 (lower diagram). The vibration is a monotone hammering in the piping (not shown in FIGS. 1 and 2) connected to the inlet flange 31. The vibration is thus caused by an external fault originating outside the pump 3. The first signals (upper diagram) and second signals (lower diagram) look similar in shape and frequency indicating a high degree of coherence between the first and second signals. The evaluation module 9 determines a degree of coherence between the first signals and the second signals by calculating a correlation function as shown in FIG. 4. The distance between the first vibration sensor 5 at the pumphead 11 and the second vibration sensor 7 at the base member 29 means that the frequency of the first signals is slightly lower than the frequency of the first signals, because the vibrations reaching the second vibration sensor 7 must in addition travel upward the pump housing 23 to reach the first vibration sensor 5. This difference in frequency can be determined by the auto-covariance plot shown in FIG. 4 and/or the spectrogram as shown in FIG. 5. The auto-covariance plot shown in FIG. 4 can be used to obtain the best vibration time-series for determining the time delay between the signals. For instance, the largest absolute value of the normalized cross-correlation c may indicate the best choice for non-periodic signals. In case of periodic signals, the shortest time delay may be chosen among several maxima in the normalized cross-correlation c. The spectrogram as shown in FIG. 5 is useful for cross-checking a time-series matching in several frequency bands in parallel. The frequency deviation represents the time delay caused by the distance between the sensors 5, 7. As the speed of sound for longitudinal sound waves in the material, e.g. stainless steel, of the pump housing 23 and the distance between the sensors 5, 7 is known, an expected frequency deviation is known and can be compared with the determined frequency deviation. With a sampling rate of 44.1 kHz, for instance, the minimum distinguishable distance will be approximately 10 cm+/−50% depending on the pump housing material. If the determined frequency deviation matches with the expected frequency deviation within a certain confidence interval, the evaluation module 9 identifies the vibration as an external fault type. The evaluation module 9 further performs a spectral analysis of the spectrogram as shown in FIG. 5 to identify the external fault type as water hammering.

In case of an internal fault originating from the pump 3, e.g. misalignment, bearing fault, drive-end (DE) bearing fault, non-drive-end (NDE) bearing fault, impeller fault or cavitation, the first vibration sensor 5 at the pumphead 11 is expected to detect characteristic vibrations earlier than the second vibration sensor 7 at the pump inlet 13. The Euclidian vector direction, i.e. the sign, of the determined time delay may thus be used to distinguish between an internal fault and an external fault. The evaluation module 9 analyses the first signals and identifies one of a subset N of n types of internal faults originating inside the pump, where $1 \leq n \leq k$ and (n, k E N). A comparison with the second signals is then used to validate or reject such an identification in order to increase the confidence in the identification of an internal fault type based on the first signals.

Where, in the foregoing description, integers or elements are mentioned which have known, obvious or foreseeable equivalents, then such equivalents are herein incorporated as if individually set forth. Reference should be made to the claims for determining the true scope of the present disclosure, which should be construed so as to encompass any such equivalents. It will also be appreciated by the reader that integers or features of the disclosure that are described as optional, preferable, advantageous, convenient or the like are optional and do not limit the scope of the independent claims.

The above embodiments are to be understood as illustrative examples of the disclosure. It is to be understood that any feature described in relation to any one embodiment may be used alone, or in combination with other features described, and may also be used in combination with one or more features of any other of the embodiments, or any combination of any other of the embodiments. While at least one exemplary embodiment has been shown and described, it should be understood that other modifications, substitutions and alternatives are apparent to one of ordinary skill in the art and may be changed without departing from the scope of the subject matter described herein, and this application is intended to cover any adaptations or variations of the specific embodiments discussed herein.

In addition, "comprising" does not exclude other elements or steps, and "a" or "one" does not exclude a plural number. Furthermore, characteristics or steps which have been described with reference to one of the above exemplary embodiments may also be used in combination with other characteristics or steps of other exemplary embodiments described above. Method steps may be applied in any order or in parallel or may constitute a part or a more detailed version of another method step. It should be understood that there should be embodied within the scope of the patent warranted hereon all such modifications as reasonably and properly come within the scope of the contribution to the art. Such modifications, substitutions and alternatives can be made without departing from the spirit and scope of the disclosure, which should be determined from the appended claims and their legal equivalents.

While specific embodiments of the invention have been shown and described in detail to illustrate the application of the principles of the invention, it will be understood that the invention may be embodied otherwise without departing from such principles.

LIST OF REFERENCE SYMBOLS

1 pump system
3 multi-stage centrifugal pump
5 first sensor
7 second sensor
9 evaluation module
11 pumphead
13 pump inlet
15 first communication line
17 second communication line
23 pump housing
25 motor stool
27 shaft seal
29 base member
31 inlet flange
33 outlet flange
35 pump outlet
37 computer device
39 third sensor
41 plug
43 third communication line
R rotor axis

The invention claimed is:

1. A sensor arrangement for monitoring a circulation pump system with at least one pump, wherein the sensor arrangement comprises:

a first vibration sensor installed at a first pump part of the at least one pump;

a second vibration sensor installed at a second pump part of said at least one pump, wherein the first pump part and the second pump part have a distance to each other; and an evaluation module, wherein the evaluation module is configured to discriminate between at least two of $k \geq 2$ different types of faults based on comparing first signals received from the first vibration sensor and second signals received from the second vibration sensor, wherein the evaluation module is configured to analyze a time delay between the first signals and the second signals to distinguish between inlet-sided external faults and outlet-sided external faults.

2. The sensor arrangement according to claim 1, wherein the different types of faults comprise at least a subset N of $1 \leq n \leq k$ types of internal faults originating inside the pump, the subset N comprising at least one type of fault selected from the group consisting of: speed fault, pressure fault, misalignment, bearing fault, drive-end bearing fault, non-drive-end bearing fault, impeller fault, cavitation, dry-running, and water hammer.

3. The sensor arrangement according to claim 1, wherein the different types of faults comprise at least a subset M of $1 \leq m \leq k$ types of external faults originating outside the pump, the subset M comprising at least one type of fault selected from the group consisting of: external fault, inlet-sided external fault and outlet-sided external fault.

4. The sensor arrangement according to claim 1, wherein the different types of faults comprise at least a subset N of $1 \leq n < k$ types of internal faults originating inside the pump and a subset M of $1 \leq m < k$ types of external faults originating outside the pump.

5. The sensor arrangement according to claim 1, wherein the evaluation module is configured to discriminate between at least two of $k \geq 2$ different types of faults based on the first signals and to validate or reject such a discrimination based on the second signals.

6. The sensor arrangement according to claim 1, wherein the first vibration sensor comprises a vibration sensor element and at least one sensor element selected from the group consisting of: pressure sensor element, accelerometer element, ultrasonic sensor element, and optical sensor element.

7. The sensor arrangement according to claim 1, wherein the second vibration sensor comprises a vibration sensor element and at least one sensor element selected from the group consisting of: pressure sensor element, accelerometer element, ultrasonic sensor element, and optical sensor element.

8. The sensor arrangement according to claim 1, wherein the evaluation module is configured to discriminate between types of faults based on a comparison of run-time information of the first signals and the second signals.

9. The sensor arrangement according to claim 1, wherein a third vibration sensor is located at a pumphead of the pump, wherein the first vibration sensor is located at one of an inlet and an outlet of the pump and the second vibration sensor is located at another one of the inlet and the outlet of the pump, wherein the evaluation module is configured to discriminate between the at least two of $k \geq 2$ different types of faults based on comparing the first signals received from the first vibration sensor, the second signals received from the second vibration sensor and third signals received from the third vibration sensor.

10. The sensor arrangement according to claim 1, wherein the evaluation module is configured to compare a first frequency spectrum of the first signals with a second frequency spectrum of the second signals.

11. The sensor arrangement according to claim 1, wherein the evaluation module is configured to determine a degree of coherence between the first signals and the second signals.

12. The sensor arrangement according to claim 1, wherein the evaluation module is integrated in the first vibration sensor or second vibration sensor.

13. The sensor arrangement according to claim 1, wherein the evaluation module is external to the first vibration sensor and second vibration sensor, the first pump part comprising one of an inlet of the pump and an outlet of the pump, the second pump part comprising another one of the inlet of the pump and the outlet of the pump, the first vibration sensor being located in an area of the one of the inlet of the pump and the outlet of the pump, the second vibration sensor being located in an area of the another one of the inlet of the pump and the outlet of the pump.

14. The sensor arrangement according to claim 1, further comprising a communication module for wireless communication with at least one of a computer device and the evaluation module, external to the first vibration sensor and second vibration sensor.

15. A circulation pump system comprising:

at least one pump; and a sensor arrangement, the sensor arrangement comprising:

a first vibration sensor installed at a first pump part of the at least one pump;

a second vibration sensor installed at a second pump part of said at least one pump, wherein the first pump part and the second pump part are spaced a distance from each other; and an evaluation module, wherein the evaluation module is configured to discriminate between at least two of $k \geq 2$ different types of faults based on comparing first signals received from the first vibration sensor and second signals received from the second vibration sensor, wherein the evaluation module is configured to analyze a time delay between the first signals and the second signals to distinguish between inlet-sided external faults and outlet-sided external faults.

16. The circulation pump system according to claim 15, wherein the at least one pump is a multi-stage centrifugal pump with a stack of impeller stages, wherein a third vibration sensor of the sensor arrangement is installed at a high-pressure side of the stack of impeller stages and the second vibration sensor of the sensor arrangement is installed at the second pump part, provided at a pump inlet and/or a pump outlet distanced to the first pump part.

17. The circulation pump system according to claim 16, wherein the third vibration sensor of the sensor arrangement is installed at a pumphead of the at least one pump, the second vibration sensor of the sensor arrangement is installed at the pump inlet and the first vibration sensor of the sensor arrangement is installed at the pump outlet.

18. The method according to claim 16, wherein the different types of faults comprise at least a subset N of $1 \leq n \leq k$ types of internal faults originating inside the pump, the subset N comprising at least one type of fault selected from the group consisting of: speed fault, pressure fault, misalignment, bearing fault, drive-end bearing fault, non-drive-end bearing fault, impeller fault, cavitation, dry-running, and water hammer.

19. The method according to claim 16, wherein the different types of faults comprise at least a subset M of $1 \leq m \leq k$ types of external faults originating outside the pump, the subset M comprising at least one type of fault selected from the group consisting of: external fault, inlet-sided external fault and outlet-sided external fault.

20. The method according to claim 16, wherein the different types of faults comprise at least a subset N of $1 \leq n < k$ types of internal faults originating inside the pump and a subset M of $1 \leq m < k$ types of external faults originating outside the pump.

21. The method according to claim 16, wherein the step of discriminating comprises discriminating between at least two of $k \geq 2$ different types of faults based on the first signals and validating or rejecting such a discrimination based on the second signals.

22. The method according to claim 16, wherein the step of discriminating is based on a comparison of run-time information of the first signals and the second signals.

23. The method according to claim 16, wherein a third vibration sensor is located at a pumphead of the pump and the second vibration sensor is located at one of an inlet and an outlet of the pump, the first vibration sensor being located at another one of the inlet and the outlet of the pump.

24. The method according to claim 16, wherein the step of discriminating comprises comparing a first frequency spectrum of the first signals with a second frequency spectrum of the second signals.

25. The method according to claim 16, wherein the step of discriminating comprises determining a degree of coherence between the first signals and the second signals.

26. The method according to claim 16, further comprising wirelessly communicating with at least one of a computer device and an evaluation module, external to the first vibration sensor and second vibration sensor.

27. A method for monitoring an operation of a circulation pump system, the method comprising:

receiving first signals from a first vibration sensor arranged at a first pump part of a pump of the circulation pump system, receiving second signals from a second vibration sensor arranged at a second pump part of said pump of the circulation pump system, wherein the first pump part and the second pump part have a distance to each other, and discriminating between at least two of $k \geq 2$ different types of faults based on comparing the first signals and the second signals, wherein a time delay between the first signals and the second signals is analyzed to distinguish between inlet-sided external faults and outlet-sided external faults.

* * * * *